US010767455B2

(12) United States Patent
Gaither, Jr.

(10) Patent No.: US 10,767,455 B2
(45) Date of Patent: Sep. 8, 2020

(54) METHOD AND APPARATUS FOR EXTRACTING HEAVY OIL

(71) Applicant: O. Duane Gaither, Jr., Houston, TX (US)

(72) Inventor: O. Duane Gaither, Jr., Houston, TX (US)

( * ) Notice: Subject to any disclaimer, the term of this patent is extended or adjusted under 35 U.S.C. 154(b) by 0 days.

(21) Appl. No.: 15/152,234

(22) Filed: May 11, 2016

(65) Prior Publication Data

US 2016/0333678 A1 Nov. 17, 2016

Related U.S. Application Data

(60) Provisional application No. 62/159,741, filed on May 11, 2015.

(51) Int. Cl.
*E21B 43/12* (2006.01)
*E21B 43/25* (2006.01)

(52) U.S. Cl.
CPC ..... *E21B 43/121* (2013.01); *E21B 43/12* (2013.01); *E21B 43/25* (2013.01)

(58) Field of Classification Search
None
See application file for complete search history.

(56) References Cited

U.S. PATENT DOCUMENTS 3,196,947 A * 7/1965 Poollen ..... E21B 43/00 166/371
3,822,750 A * 7/1974 Ping ..... E21B 21/16 166/309
4,064,941 A * 12/1977 Smith ..... E21B 33/138 166/162
4,791,985 A * 12/1988 Flores Bermudez ... E21B 37/06 166/106
4,974,673 A * 12/1990 Chacin U. ..... E21B 41/02 166/106
5,083,613 A * 1/1992 Gregoli ..... B01F 3/0811 137/13
5,431,222 A * 7/1995 Bustamante ..... E21B 43/121 166/105
5,482,117 A * 1/1996 Kolpak ..... E21B 43/121 166/105.5
5,941,311 A * 8/1999 Newton ..... E21B 43/127 166/105

(Continued)

FOREIGN PATENT DOCUMENTS

CN 2692346 Y * 3/2004
WO WO2011/025590 * 3/2011 ..... E21B 43/00

OTHER PUBLICATIONS

Schlumberger Oilfield Glossary, Mandrel, retrieved Aug. 2, 2017 from http://www.glossary.oilfield.slb.com/Terms/m/mandrel.aspx.*

(Continued)

*Primary Examiner* — Angela M DiTrani Leff
(74) *Attorney, Agent, or Firm* — Michael Best & Friedrich LLP

(57) ABSTRACT

A method and apparatus for extracting and providing heavy crude oil from subterranean oil fields. The method utilizes a specially designed mixing mandrel to facilitate the combination and mixing of a high AP gravity diluent with heavy crude oil from a subterranean oil reservoir, such that the resulting heavy oil mixture can be efficiently pumped to the surface.

7 Claims, 8 Drawing Sheets

(56) References Cited

U.S. PATENT DOCUMENTS

| | | | | |
|---|---|---|---|---|
| 6,250,392 | B1 * | 6/2001 | Muth | E21B 33/122 166/105.2 |
| 6,260,628 | B1 * | 7/2001 | Magnus | F04F 1/08 166/372 |
| 2003/0015321 | A1 * | 1/2003 | Lim | C09K 8/58 166/263 |
| 2008/0083536 | A1 * | 4/2008 | Cavender | E21B 36/006 166/302 |
| 2015/0376998 | A1 * | 12/2015 | Dean | E21B 43/16 166/305.1 |
| 2016/0290111 | A1 * | 10/2016 | Patel | E21B 37/06 |
| 2018/0334880 | A1 * | 11/2018 | Jones | C04B 28/04 |

OTHER PUBLICATIONS

Schlumberger Oilfield Glossary, bitumen, retrieved Aug. 2, 2017 from http://www.glossary.oilfield.slb.com/Terms/b/bitumen.aspx.*

Kemp, New definitions needed for condensate and gas liquids, Oct. 10, 2014, retrieved Aug. 1, 2017 from http://www.reuters.com/article/us-condensate-usa-kemp-idUSKCN0HZ03220141011.*

Translation of CN 2692346 Y, obtained from google patents, Oct. 29, 2018 (Year: 2004).*

English translation of CN2692346Y, published Apr. 3, 2005 (3 pages).

* cited by examiner

METHOD AND APPARATUS FOR EXTRACTING HEAVY OIL

CROSS REFERENCE

This application claims priority to U.S. Provisional Application 62/159,741, filed May 11, 2015, the content of which is incorporated herein by reference in its entirety.

TECHNICAL FIELD

The present disclosure relates generally to a method and apparatus for extracting heavy crude oil from subterranean oil fields to produce a heavy oil mixture that possesses certain physical properties which make it amenable to further transport and processing.

BACKGROUND

Heavy crude oil is a highly viscous liquid that is solid or near solid at room temperature. With a high mass density and an API gravity of less than 20° API, there are numerous engineering challenges to extracting and processing heavy oil. In particular, the presence of high molecular weight hydrocarbon compounds such as asphaltenes contribute to the heaviness of heavy oil. Asphaltenes, which are soluble in alkanes (e.g. pentane and heptane), complicate production of heavy oil via normal methods (e.g. rod pumping) due to their tendency to agglomerate and precipitate, causing fouling in downhole pumps as well as the dumps and valves in surface process equipment.

These engineering challenges may be a deterrent to the production of heavy crude oil. However, as the price of regular crude oil increases, the economics for upgrading heavy oil to a synthetic crude oil continue to become favorable. Hence, much effort is being directed to the development of new technologies for commercial-scale applications of heavy crude oil extraction.

Blending is the established method of upgrading heavy oil, having been employed in the industry for more than 120 years. In this process, once heavy oil has been extracted and produced, it is de-watered and then blended with a locally-available lighter crude oil or condensate as a diluent to create "dilbit". The dilbit is then sent to pipelines for transport, or it may be locally consumed in an upgrading process that converts non-transportable heavy oil into a lighter synthetic crude oil. This oil can subsequently be moved by pipeline and processed in conventional oil refineries.

There are numerous oil fields that contain extremely heavy and viscous oil which can become unproductive due to the cost and engineering challenges of extracting and producing heavy oil discussed above. In view of the foregoing, there exists a need to develop and implement methods and tools for the effective, efficient, and economic extraction and production of heavy crude oil.

BRIEF DESCRIPTION OF THE DRAWINGS

FIGS. 3 and 3-1 are diagrams of the heavy oil extraction and production method.

DETAILED DESCRIPTION

Figure 1:
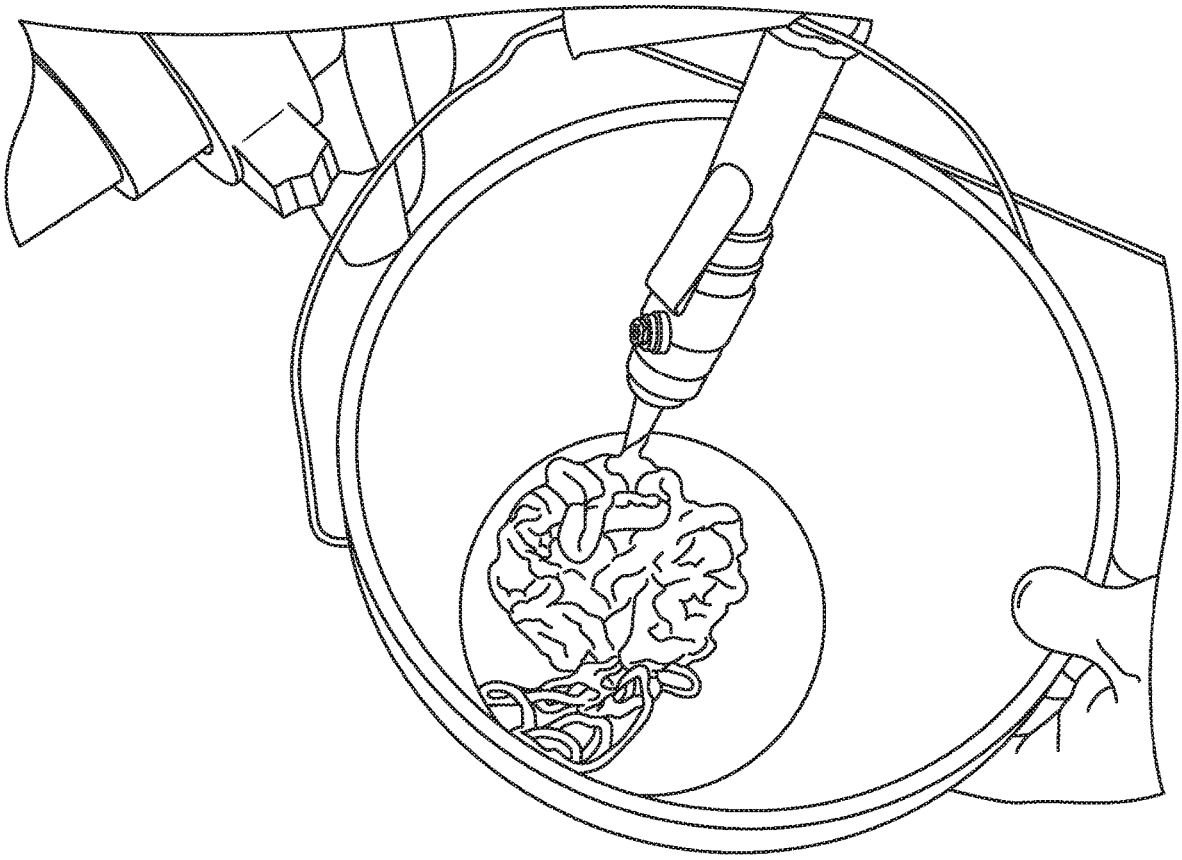
FIG. 1 is a photograph of heavy crude oil in its viscous native state.

Disclosed herein is a method and apparatus for extracting and producing heavy oil. The method includes delivery of a diluent down an oil well to a mandrel. The mandrel facilitates downhole mixing of the diluent with heavy crude oil extracted from a subterranean reservoir. The mixing results in transforming the heavy oil into a heavy oil mixture with decreased viscosity, allowing the mixture to be pumped to the surface.

The disclosed method and mandrel provide several advantages over known methods for extracting and producing heavy oil. The disclosed method and mandrel use temperature and pressure within the well bore to affect an upgrading process using a diluent downhole injection which allows one to pump extremely viscous heavy crude to the surface, and eliminates the need for surface blending operations. The method and mandrel take advantage of both elevated reservoir temperatures within the wellbore, and the properties of a high API gravity diluent to sufficiently mix with and decrease the viscosity of a heavy crude oil. This method provides a stable crude oil at surface conditions with adequate viscosity and API gravity that allow it to be pumped to the surface and transported easily (e.g. through a pipeline).

1. Definition of Terms

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present invention. All publications, patent applications, patents and other references mentioned herein are incorporated by reference in their entirety. The materials, methods, and examples disclosed herein are illustrative only and not intended to be limiting.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "an" and "the" include plural references unless the context clearly dictates otherwise. The present disclosure also contemplates other embodiments "comprising," "consisting of" and "consisting essentially of," the embodiments or elements presented herein, whether explicitly set forth or not.

The modifier "about" used in connection with a quantity is inclusive of the stated value and has the meaning dictated by the context (for example, it includes at least the degree of error associated with the measurement of the particular quantity). The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number. For example, "about 10%" may indicate a range of 9% to 11%, and "about 1" may mean from 0.9-1.1. Other meanings of "about" may be apparent from the context, such as rounding off, so, for example "about 1" may also mean from 0.5 to 1.4.

The term "BFPD" refers to barrels of fluid per day.

The American Petroleum Institute gravity, or API gravity, is a measure of how heavy or light petroleum liquid is compared to water. It is related to specific gravity (SG) by the linear relationship API gravity=141.5/(SG)−131.5, so that if the liquid's API gravity is greater than 10, the liquid is lighter than and floats on water; if the liquid's API gravity is less than 10, the liquid is heavier than water and sinks.

2. Heavy Oil Extraction and Production Method

While methods to extract and produce heavy oil via surface blending methods are inadequate due to unmanageable oil products (FIG. 1 and FIG. 2), adding diluents under elevated temperatures and pressure promotes an effective blending process albeit at higher effort and cost, yielding a stable and manageable product. Recognition of this led to the design of a method for mixing a diluent with the heavy crude oil downhole, which takes advantage of elevated reservoir temperatures and pressures within the wellbore. This method provides a stable crude oil with adequate viscosity and API gravity such that it may be pumped to the surface and preferably does not precipitate asphaltenes.

A. Diluent

The diluent of the process may be a light crude oil or condensate suitable for downhole blending. The suitable diluent may have appropriate physical properties such as high API gravity, low density, and low viscosity. The physical properties of a suitable diluent may be determined by laboratory analysis. As such, the physical properties of the diluent allow it to be mixed with heavy crude oil to form a heavy oil mixture that may be pumped effectively from a subterranean oil field reservoir to the surface. The diluent may be any light oil with a sufficiently high API gravity as listed below.

The volume of diluent used in the process may be measured based on the total volume of the heavy oil mixture that is produced and pumped to the surface. The volume of diluent may be, for example, 5-50%, 5-15%, 5-10%, 10-15%, 8-12%, or 8-10% of the total volume of the heavy oil mixture. The volume of diluent may be, for example, about 5%, about 6%, about 7%, about 8%, about 9%, about 10%, about 11%, about 12%, about 13%, about 14%, about 15%, about 16%, about 17%, about 18%, about 19%, about 20%, about 21%, about 22%, about 23%, about 24%, about 25%, about 26%, about 27%, about 28%, about 29%, about 30%, about 31%, about 32%, about 33%, about 34%, about 35%, about 36%, about 37%, about 38%, about 39%, about 40%, about 41%, about 42%, about 43%, about 44%, about 45%, about 46%, about 47%, about 48%, about 49%, or about 50% of the total volume of the heavy oil mixture. The volume of diluent may be at least 5%, at least 6%, at least 7%, at least 8%, at least 9%, or at least 10% of the total volume of the heavy oil mixture.

The diluent may have high API gravity. The API gravity of the diluent may be 42° API to 80° API, 45° API to 80° API, 50° API to 120° API, 50° API to 110° API, 50° API to 100° API, 50° API to 90° API, 50° API to 80° API, 50° API to 70° API, or 50° API to 60° API. The diluent may have an API gravity of at least 42° API, at least 43° API, at least 44° API, at least 45° API, at least 46° API, at least 47° API, at least 48° API, at least 49° API, at least 50° API, at least 51° API, at least 52° API, at least 53° API, at least 54° API, at least 55° API, at least 56° API, at least 57° API, at least 58° API, or at least 59° API.

B. Extracting and Blending Operations

Figure 2:
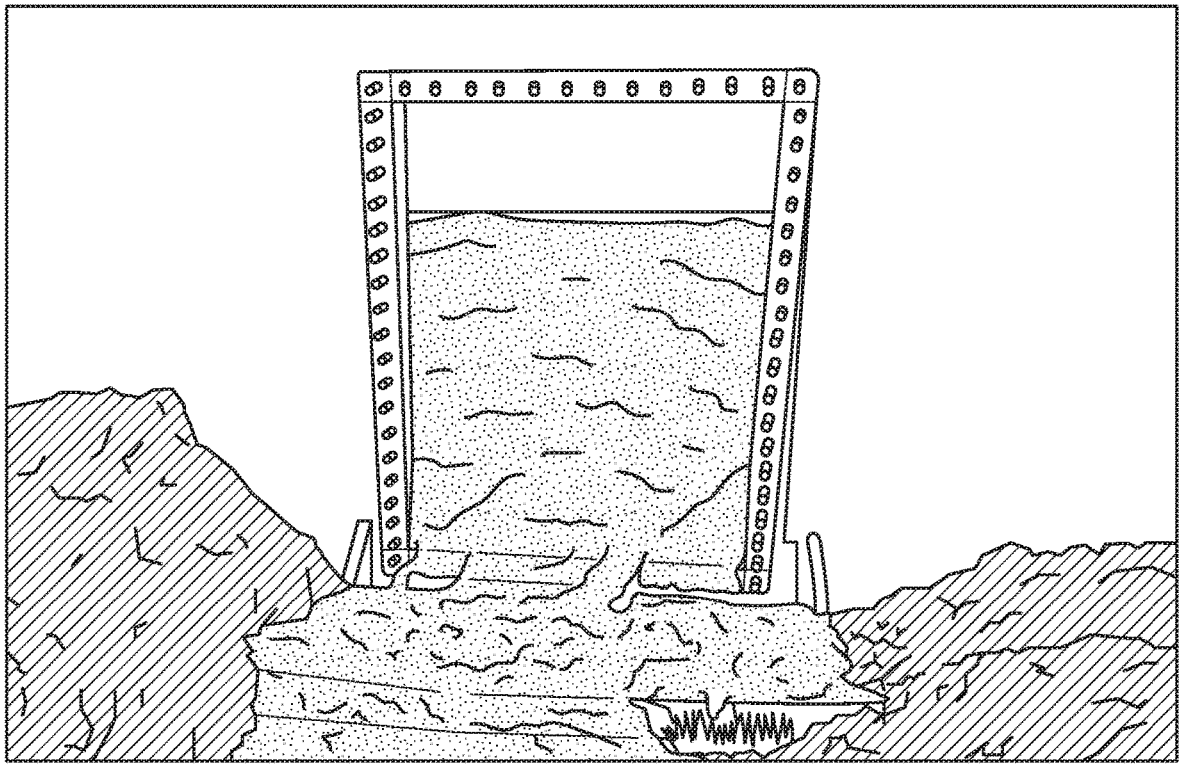
FIG. 2 is a photograph surface blended oil product that resulted in asphalt precipitation.
Figure 3:
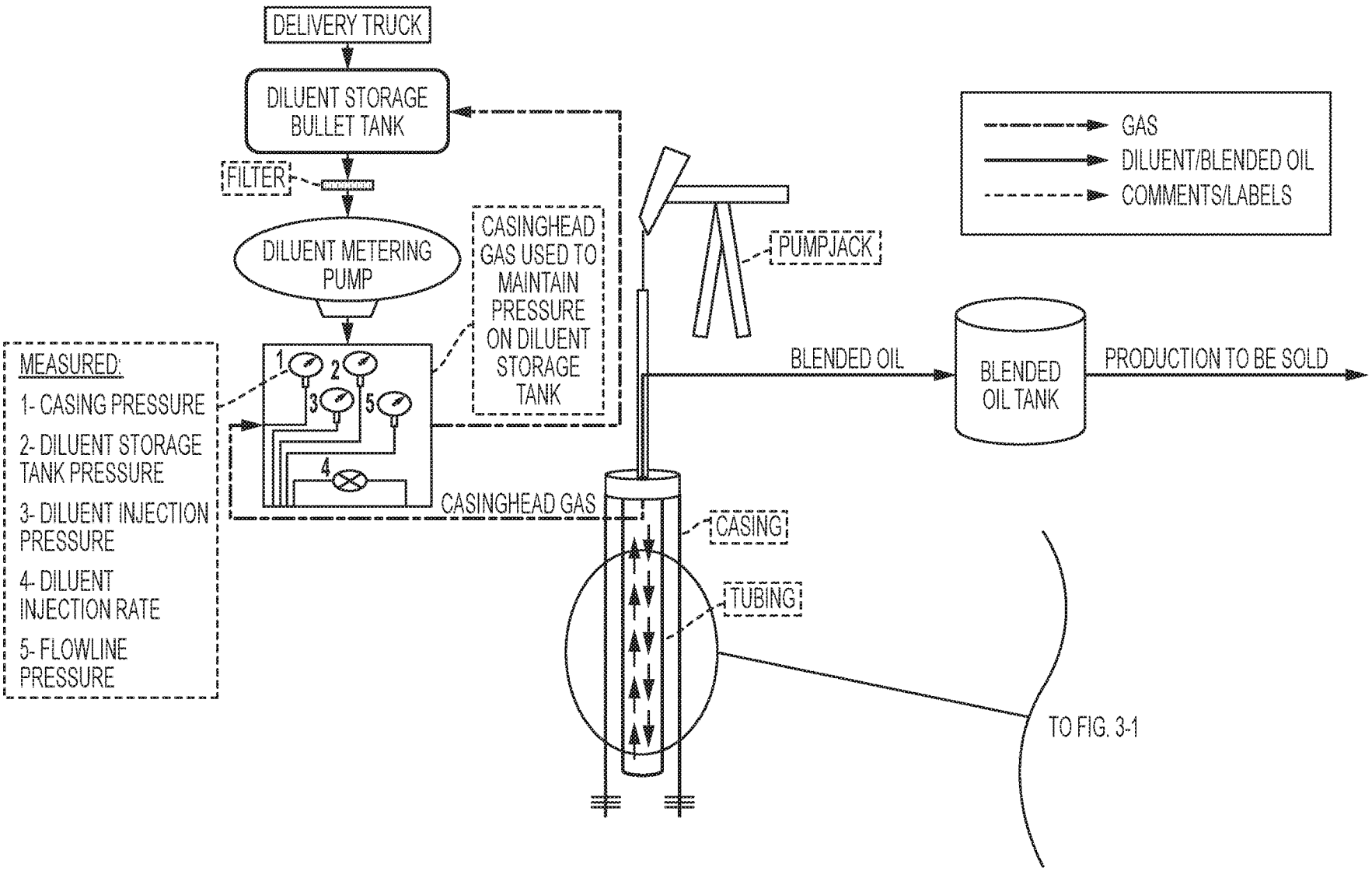
Figures 1, 3:
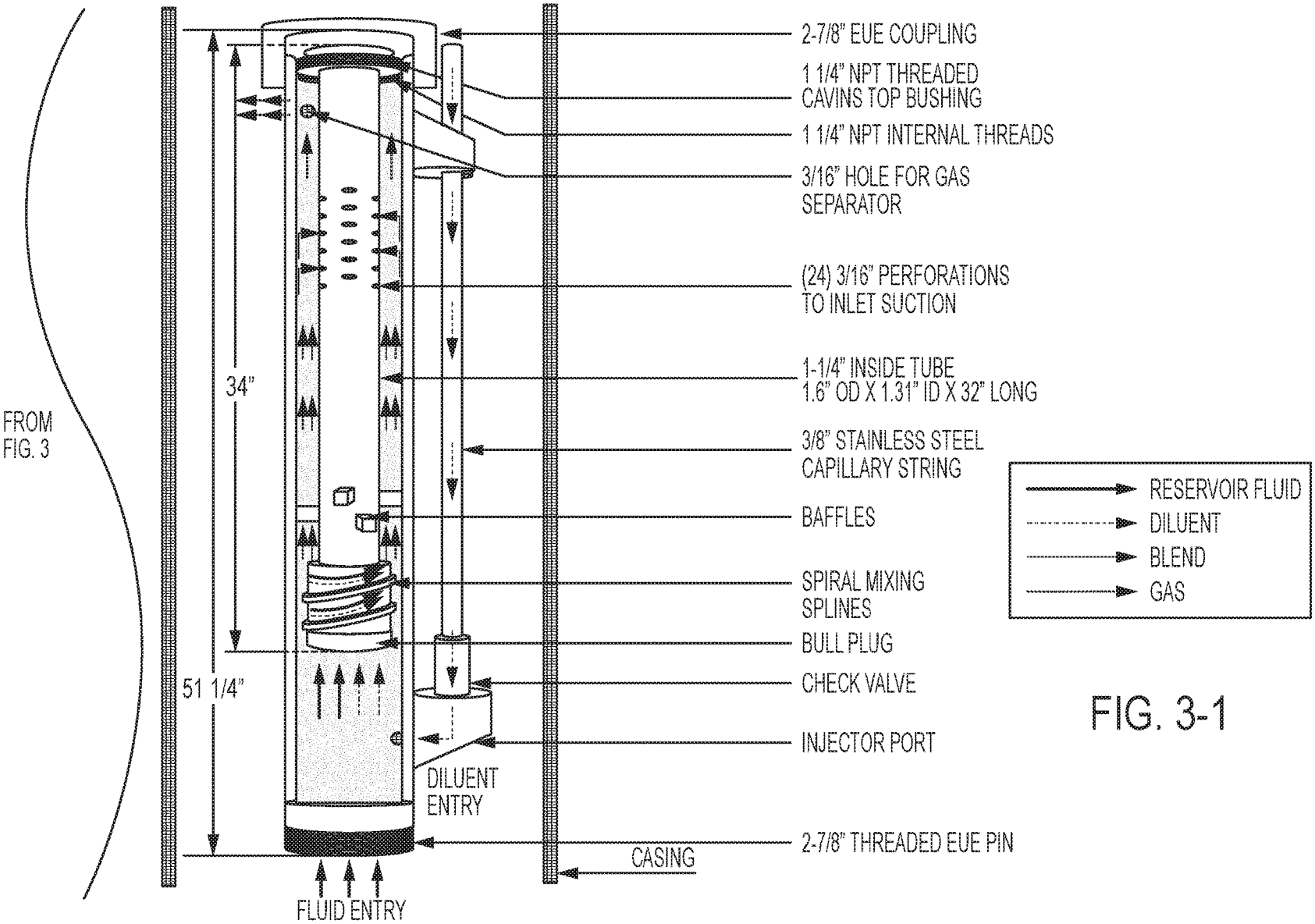

The diluent may contain particulates, solids and/or impurities. The diluent may be filtered prior to being introduced to the suction of a metering pump for delivery under pressure in to the well. A bullet tank (e.g. 1000 gallon bullet tank) may be used to contain the diluent and may be equipped with a filter to remove any particulates, solids, or impurities that may be present in the diluent. The filter may be a 10 micron, 15 GPM hydraulic filter apparatus, which is fitted just downstream of a shut off valve (FIGS. 3 and 3-1).

Figure 4:
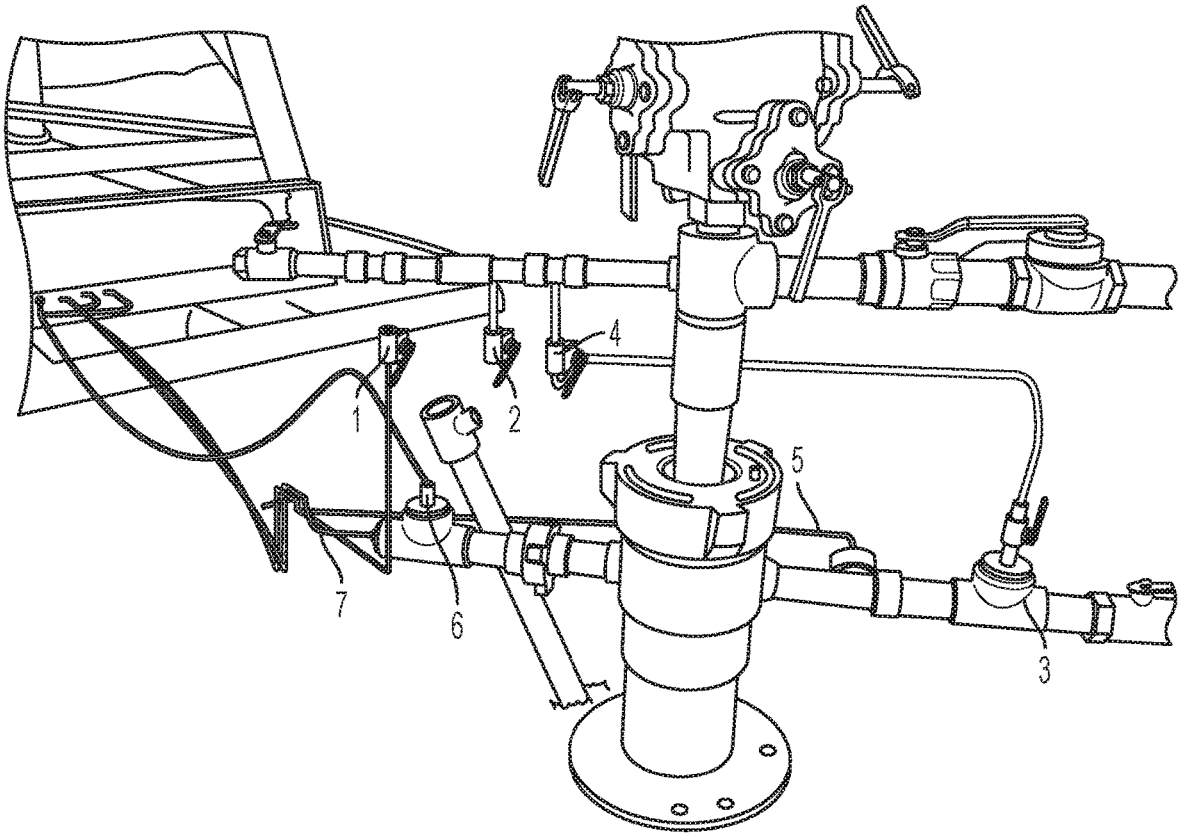
FIG. 4 is a photograph of a wellhead configuration for a typical pumping well equipped with monitoring probes and diluent injection capillary string.

A well with a conventional pumping unit may be configured such that the wellhead is equipped to monitor flowline pressure, casing pressure, diluent storage tank pressure, diluent injection pressure and diluent injection rate. Casing head gas, which is mostly nitrogen, may be captured and the pressure used to maintain pressure on the diluent storage tank and to operate separator controls at the respective production facility. The well may also be equipped with a bottom hole pressure and/or bottom hole temperature sensor. Temperature and pressure data may be transmitted to the surface via a cable, which is attached to a production tubing string alongside of a capillary tubing, which delivers the diluent from the surface downhole to a mixing valve. A suitable wellhead configuration is detailed in FIG. 4, and each component is identified in Table 1.

TABLE 1

| | |
|---|---|
| 1 | Line to Tubing/Flowline Pressure Sensor |
| 2 | Surface Sample and Observation Valve |
| 3 | Vent Line from Casing to Flowline |
| 4 | Casing Pressure Vent Check Valve Assembly |
| 5 | Line to Casing Pressure Sensor |
| 6 | Cable to Down Hole BHT & BHP Sensor |
| 7 | Capillary String to Mixing Down Hole Mixing Valve |

From the wellhead the diluent travels down a tubing string to the downhole mixing mandrel installed in the production tubing string. The tubing string is preferably adequate in size to deliver the required amount of diluent downhole at minimal pressure. For example, the tubing can be a selected size (e.g., ⅜ inch, 1 inch, or greater) and material (e.g., stainless steel) to accomplish delivery of the diluent to the downhole mixing mandrel. The mixing mandrel may be just beneath the barrel of a rod pump (e.g., a 1½" rod pump, a 2½" rod pump, or a 5 inch rod pump), or may be above or below the rotor and stator of a progressive cavity rod pump. The mixing mandrel is not limited to a particular production tubing string. For example, the mixing mandrel may be configured for and used with a gas lift operation or an electric submersible pump. In such embodiments, the mixing mandrel may lack mixing spiral components and an inner tube.

At a given production rate, the fluid transmitted from the pump will take a period of time to reach the surface, and during this time the extracted heavy oil and diluent are thoroughly mixed and exposed to varying degrees of temperature and pressure. For example, at a production rate of about 40 BFPD and 60% pump efficiency, fluid may be transmitted from the pump intake to the surface in about one day, and during this period of time the extracted heavy oil and diluent are thoroughly mixed and exposed to varying degrees of temperature and pressure. The result is a stabilized heavy oil mixture when the blend reaches the tank at the surface. The amount of diluent may be adjusted according to the production rate such that the diluent comprises a percentage of the total volume of the produced heavy oil mixture that is commensurate with the method disclosed herein.

The concentration of diluent that is most efficient and cost effective at a given reservoir temperature and pressure can be identified by laboratory analysis. In an embodiment, the method provides a mechanism to accurately and effectively measure and deliver a diluent into a well such that delivery of the diluent results in production of an oil mixture comprising, for example, about 10% diluent of the total volume of the produced heavy oil mixture. The controlled and measured rate of delivery of the diluent may be achieved by automation of the process.

Figure 6:
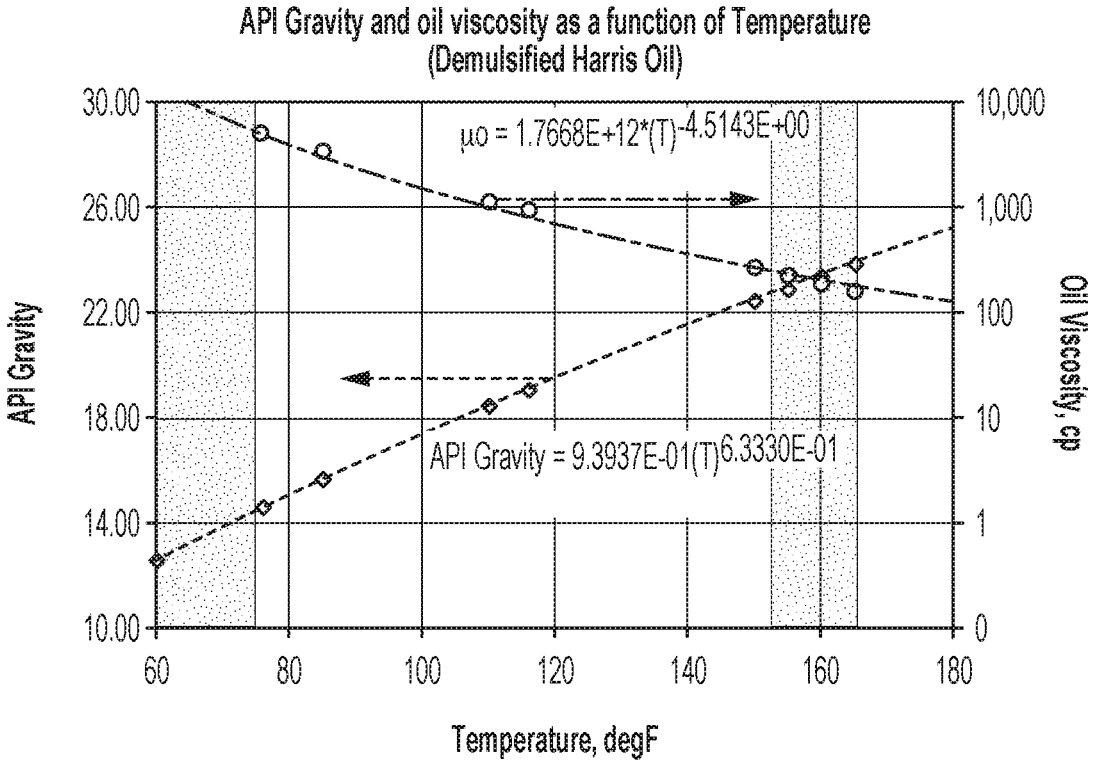
FIG. 6 is a graph depicting the effect of temperature on API gravity and viscosity. Crude oils are very complex combinations of hydrocarbons. They are not fully characterized when compared to fuels and petroleum products. Viscosity is an evaluated property of crude oil from the standpoint of production, storage and transportation and is often closely related to the API gravity. Viscosity may be affected by a number of factors, including the pressure and temperature at which viscosity measurements are taken. In the present case, increasing amounts of heat were applied to study the effect on a host crude oil, in terms of both API Gravity and viscosity. A cone and plate viscometer was used to measure the viscosity of the host heavy crude oil and a gravitometer was used to record the observed API gravity at the temperatures studied. Stabilized temperatures at which the host crude oil was tested included, 75° F., 85° F., 110° F., 115° F., 150° F., 155° F., 160° F. and 165° F. The results depicted in FIG. 6 indicate that as temperature increased, API Gravity also increased from 14.5° API to 24° API across the range of temperatures tested. Conversely, as temperature increased, viscosity was noted to decrease, falling from approximately 9000 cps to less than 200 cps on the sample cited.
Figure 7:
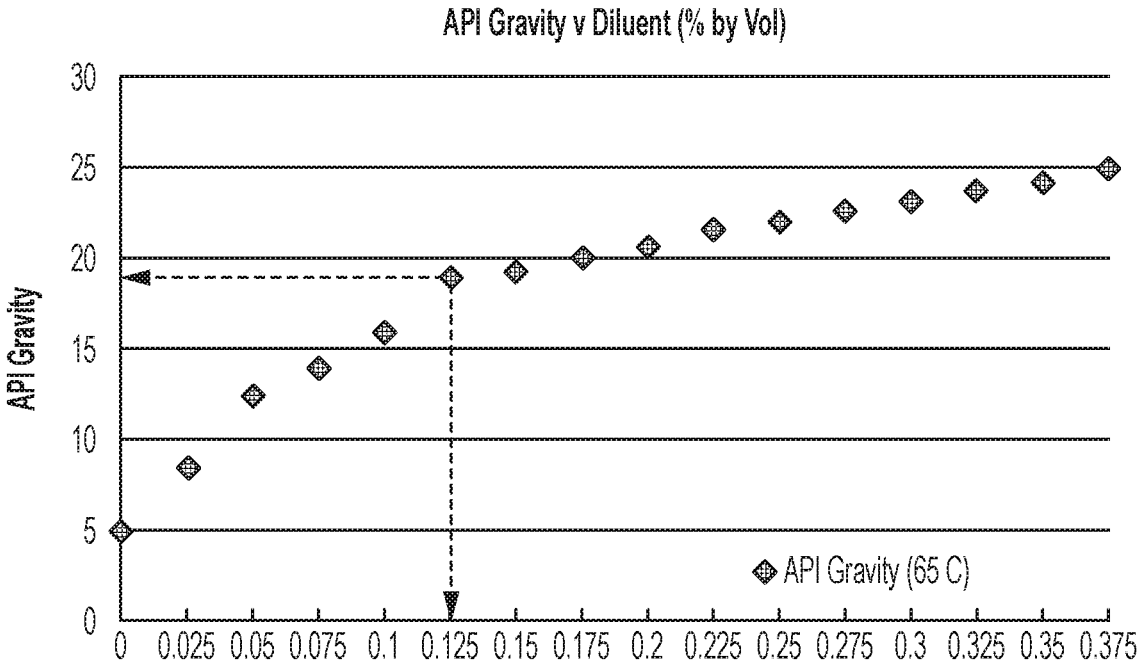
FIG. 7 is a plot depicting increase in API gravity with increasing volume of diluent for a given post-heavy oil and diluent. Concern in the upstream well and gas industry regarding gravity and viscosity is primarily related to transportation. The energy required to transport petroleum through pipelines is proportional to the viscosity of the fluid being transported. In the present case, a sample of a specific heavy crude oil was used to study the effects of blending increasing amounts of a selected diluent, at a given temperature of 65° C. (chosen to approximate down hole conditions for blending within a specific wellbore). As reflected in FIG. 7 and Table 2, while being held at a temperature of 65° C., as the amount of diluent added was increased to 12.5% by volume, a reasonably uniform rate of API gravity increase was noted. Note however that this characteristic changes at 12.5% by volume, resulting in the graphical inflection point identified on FIG. 7. The result of this work indicated that blending 12.5% by volume of the tested diluents in to the specific host heavy oil sample increased the API gravity from 5° to 19°, however, to continue to increase the API gravity from 19° to 25° took three times the amount. These results underscore the notion that adjusting blending rates to obtain certain crude characteristics at optimal conditions can greatly affect the economics of a given project.

Mixing the diluent at a selected concentration volume of the produced oil (e.g., about 10% by volume of the produced oil) provides a useful process for extracting and producing the heavy crude oil, which has an API gravity of less than, for example, 20° API in its natural state. Employment of the diluent and effective downhole mixing with the heavy crude oil raises the API gravity of the heavy oil mixture to over, for example, 19° or 20° API, providing a sufficiently diluted oil mixture that may be pumped to the surface. FIG. 6 graphically illustrates the relationships between oil viscosity, API gravity and temperature. The physical properties shown here allow for the production of heavy oil mixtures with sufficient viscosities and API gravities to be pumped to the surface.

The heavy crude oil may have an API gravity of about 8° API to about 20° API, about 10° API to about 20° API, about 8° API to about 12° API, or about 10° API to about 12° API in its natural state. The heavy crude oil may have an API gravity of less than 20° API, less than 18° API, less than 16° API, less than 14° API, or less than 12° API in its natural state.

After downhole mixing, the produced heavy oil mixture may have an API gravity of at least 19° API, of at least 20° API, at least 21° API, at least 22° API, at least 23° API, at least 24° API, or at least 25° API. The produced heavy oil mixture may have an API gravity that is sufficiently high enough to allow it to be pumped to the surface.

3. Downhole Mixing Mandrel Design

Figure 5:
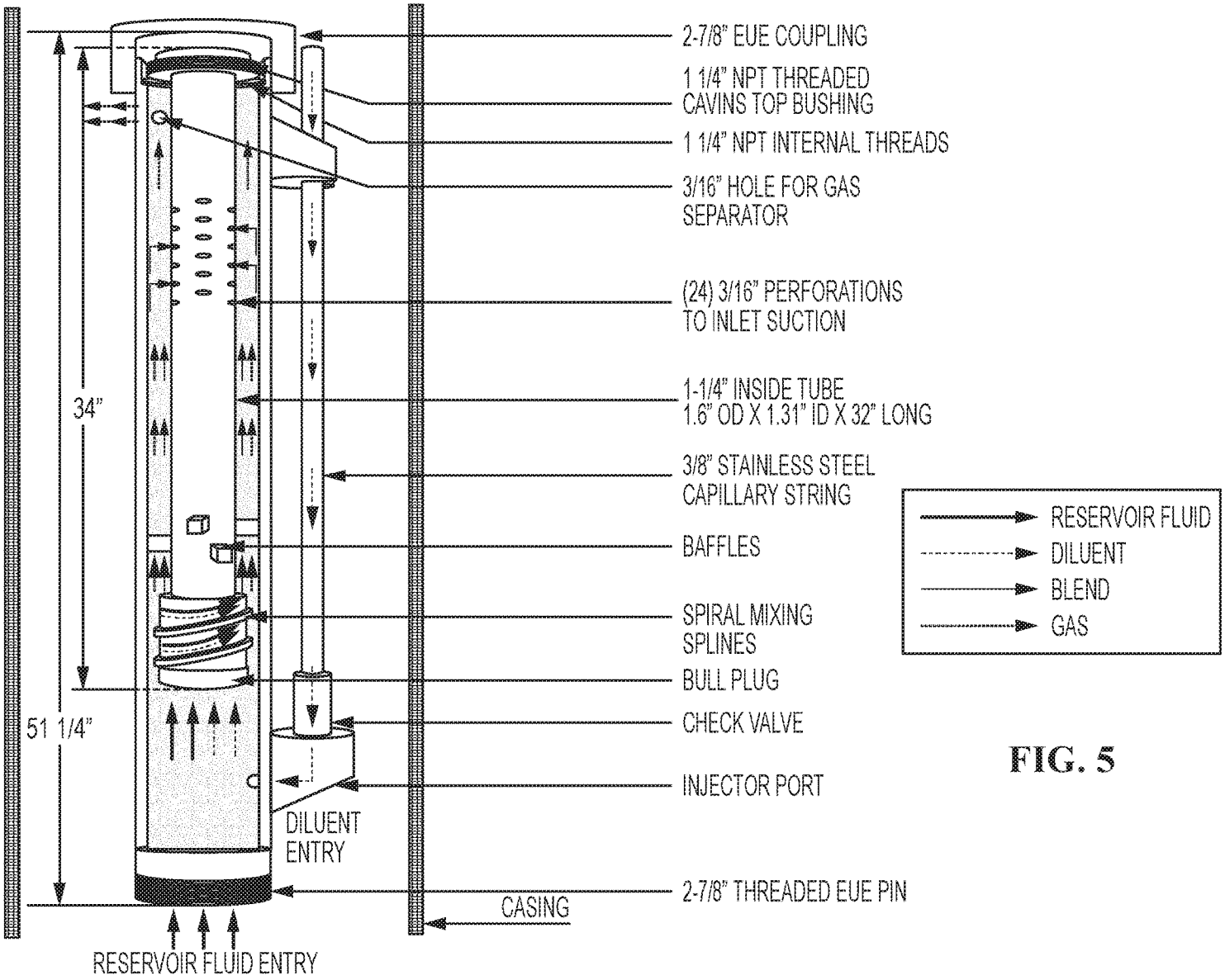
FIG. 5 is a downhole mixing mandrel.

For a conventional pumping unit (e.g., a rod pump), a downhole mixing mandrel is disclosed for the purpose of mixing the heavy oil with the diluent (see FIG. 5). In certain embodiments, the mandrel can be configured for use with a gas lift well, with a progressive cavity pump well, or the like. For example, in certain embodiments where the mandrel is configured for use with a progressive cavity pump, the mandrel may exclude the mixing spiral components and the inner tube.

The 4' by 2⅞" EUE 8rd pup joint has a threaded upset which accommodates a 1¼" NPT bushing. The bushing is connected to a 1¼" perforated dip tube equipped with a bull plug, a mixing spiral, and baffles. The mixing spiral is placed across from or just above the diluent injection port in the pup joint. The diluent is injected down the capillary string, through a 2000 psi check valve and into the lower section of the pup joint.

In various embodiments, the mixing mandrel (FIG. 5) includes a dip tube disposed within a production tube, where the production tube has a top end, a bottom end, and a wall extending between the top end and the bottom end. The dip tube has a top end, a bottom end which is generally closed, an outside surface extending between the top end and the bottom end, and an annular space between the wall of the production tube and the outside surface of the dip tube. The dip tube is hollow and the outside surface of the dip tube includes a plurality of perforations therein. The rod pump is just above the dip tube and generates suction which pulls fluid (i.e. blended oil) through the perforations.

The mandrel includes a bushing connected to the top end of the dip tube, where the bushing is coupled to the top end of the production tube. The mandrel also includes at least one spiral mixing spline and one or more baffles projecting into the annular space. Generally the spline and baffles are attached to the outside surface of the dip tube although in some embodiments the spline and/or the baffles may be attached to the inner surface of the production tube, in either case having the effect of projecting into the annular space and creating turbulence to promote mixing when fluid moves through the annular space.

The mandrel also has a reservoir fluid entry port disposed at the bottom end of the production tube and a diluent fluid injector port disposed in the wall of the production tube, typically near the bottom end of the production tube. In general the diluent fluid entry port and reservoir fluid entry port are located below the level of the spline and baffles so that the heavy oil and diluent fluid must move past the spline and baffles before exiting the annular space.

In use, a diluent fluid is introduced into the production tube through the diluent fluid injector port (the diluent fluid reaching the port via a capillary tubing string) such that the diluent fluid contacts heavy oil entering the production tube through the reservoir fluid entry port. As a result of pumping action, the diluent fluid and the heavy oil move through the annular space past the at least one spiral mixing spline and the plurality of baffles and are mixed together to form a crude oil mixture. The crude oil mixture then exits the annular space through the plurality of perforations in the dip tube and into the intake of the pump.

In certain embodiments the production tube also includes a gas exit port disposed in the wall above a level of the plurality of perforations in the dip tube, such that gas released during mixing of the heavy oil and the diluent fluid and produced gas exits the annular space through the gas exit port. In some embodiments a bull plug is placed over the bottom end of the dip tube such that the bull plug closes the bottom end of the dip tube.

On each upstroke of the pumping unit, fluid from the wellbore (dark green) is drawn into the open end of the pup joint and must travel around the mixing spiral and through the mixing baffles along with the injected diluent (light green). The mixing spiral and mixing baffles aid in the mixing of the reservoir fluid and the injected diluent to achieve a uniform blend.

Gas (red) that comes out of the blended liquid due to the whirling action of the mixing spiral and the pressure drop related to the pumping process (e.g., gas liberated during the suction stroke) travels through the annulus (gray area) and exits through the hole (e.g. 3/16" hole) at the top into the tubing/casing annulus. The blended liquid (purple) is drawn through the perforated section of the dip tube and into the intake of the pump.

At a rate a selected rate (e.g., 40 BFPD) and pump efficiency (e.g., 60% pump efficiency), it can take, for example, approximately a day for the fluid to be transmitted from the pump intake to the surface. During this period of time the produced oil and diluent are thoroughly mixed and exposed to varying degrees of temperature and pressure. The result is a stabilized blend when the oil reaches the tank at the surface.

Various changes and modifications to the disclosed embodiments will be apparent to those skilled in the art. Such changes and modifications, including without limitation those relating to the chemical structures, substituents, derivatives, intermediates, syntheses, compositions, formulations, or methods of use of the invention, may be made without departing from the spirit and scope thereof.

Table 2.

| API Gravity test results ml condensate | 400 ml oil test @ 65 C. APIG |
|---|---|
| 10 | 8.5 |
| 20 | 12.5 |

-continued

| API Gravity test results ml condensate | 400 ml oil test @ 65 C. APIG |
|---|---|
| 30 | 14.0 |
| 40 | 16.0 |
| 50 | 19.0 |
| 60 | 19.4 |
| 70 | 20.1 |
| 80 | 20.7 |
| 90 | 21.7 |
| 100 | 22.1 |
| 110 | 22.7 |
| 120 | 23.2 |
| 130 | 23.8 |
| 140 | 24.3 |
| 150 | 25.0 |

What is claimed is:

1. A method of extracting heavy oil from a subterranean oil field using a subterranean oil well, wherein the subterranean oil well includes a wellhead, a pump having an inlet, and a mixing mandrel at least partially positioned within a production tube to form an annular space therebetween, wherein the annular space includes a spiral mixing spline positioned therein, wherein the annular space includes a radially extending baffle positioned therein downstream of the spiral mixing spline, and wherein the spiral mixing spline and the radially extending baffle extends radially outwardly from the mixing mandrel, the method comprising:

injecting a diluent into the wellhead of the subterranean oil well;

pumping the diluent down the subterranean oil well;

contacting the diluent with heavy oil from a subterranean oil field;

directing the diluent and heavy oil into the annular space;

directing the diluent and heavy oil over the spiral mixing spline and over the radially extending baffle to form a heavy oil mixture;

directing the heavy oil mixture into the inlet of the pump; and pumping the heavy oil mixture to the surface.

2. The method of claim 1, wherein the heavy oil mixture comprises, by volume, about 5-50% of the diluent.

3. The method of claim 1, wherein the heavy oil mixture comprises, by volume, about 5-15% of the diluent.

4. The method of claim 1, wherein the API gravity of the heavy oil mixture is at least 19° API or greater.

5. The method of claim 1, wherein the API gravity of the diluent is at least 50° API.

6. The method of claim 1, wherein the pump includes one of a rod pump, a progressive cavity pump, and a hydraulic pump.

7. The method of claim 1, wherein the inlet of the pump is positioned downstream of the mixing mandrel.

* * * * *